United States Patent [19]

Lepetic

[11] 4,081,364

[45] Mar. 28, 1978

[54] FROTH FLOTATION METHOD FOR STIBNITE

[75] Inventor: Vuko M. Lepetic, Iselin, N.J.

[73] Assignee: Engelhard Minerals & Chemicals Corporation, Menlo Park, N.J.

[21] Appl. No.: 703,513

[22] Filed: Jul. 8, 1976

Related U.S. Application Data

[63] Continuation-in-part of Ser. No. 608,110, Aug. 2, 1977, abandoned.

[51] Int. Cl.[2] ..... B03D 1/02

[52] U.S. Cl. ..... 209/167; 75/2

[58] Field of Search ..... 75/1, 2, 121, 105; 209/166, 167; 423/87, 26

[56] References Cited

U.S. PATENT DOCUMENTS

| | | | |
|---|---|---|---|
| 3,252,662 | 5/1966 | Lyons et al. | 209/166 |
| 3,847,357 | 11/1974 | Weston | 209/167 |
| 4,014,474 | 3/1977 | Anttila et al. | 209/167 |

*Primary Examiner*—L. Dewayne Rutledge
*Assistant Examiner*—Michael L. Lewis
*Attorney, Agent, or Firm*—Inez L. Moselle

[57] ABSTRACT

Disclosed is a process for concentrating stibnite (antimony sulfide) and separating it from iron sulfide minerals such as pyrite by froth flotation using untreated recirculated water or mine water which is acidic and may be heavily loaded with metal salts. The process features the use of a water-soluble zinc-cyanide complex salt to depress iron sulfide minerals. A conventional xanthate collector is employed. The process may also be applied to separate sulfides of arsenic, bismuth, tin and lead, as well as complexes of sulfides of arsenic, antimony, tin or bismuth, or mixtures of the aforementioned, from iron sulfide minerals or from sulfides of copper, zinc and nickel, or mixtures of the aforementioned.

5 Claims, No Drawings

FROTH FLOTATION METHOD FOR STIBNITE

RELATED APPLICATIONS

This application is a continuation-in-part of Ser. No. 608,110, filed Aug. 27, 1975, now abandoned.

BACKGROUND OF THE INVENTION

1. Field of the Invention

This invention is directed to the selective flotation of sulfide minerals from other sulfide minerals. A prime objective is to provide a simple and relatively inexpensive process for practicing selective sulfide flotation using untreated acidic salt-laden water as found in an available source to form the flotation pulp. A specific objective is to provide a simple method for depressing sulfide minerals such as pyrite when using untreated sulfide mine water or untreated water recirculated (recycled) from a sulfide mill so that the to-be-floated sulfide mineral may be concentrated economically.

Flotation plants generally require large amounts of water and the availability of an adequate water supply can be a decisive factor in the selection of a site for a flotation plant. When the plant is to be located in the neighborhood of the mine and an abundant supply of good quality water cannot be conveniently hauled to the plant, it becomes necessary to utilize water available at the plant site. This available water may include so-called "mine water," (as described in SME MINING ENGINEERING HANDBOOK, published by Society of Mining Engineers of the American Institute of Mining, Metallurgical and Petroleum Engineers, Inc. (1973) 26.2–26.6). In some cases it becomes necessary to recirculate water from tailing ponds, thickeners and the like as described in Taggart's HANDBOOK OF ORE DRESSING, published by John Wiley & Sons, Inc. (1927), page 1276.

A considerable number of flotation plants treating sulfide ores must use water originating from mines and/or recirculated water. It is well known that sulfide mine water is usually acidic and contains high concentrations of sulfates of metals such as Fe, Mg, Ca, Na, K, Al, etc. The origin of acidity and an explanation for the occurrence of sulfate salts in mine water appear in the SME hamdbook. In many cases water recirculated from effluents obtained from mills handling sulfide ores is also acidic and salt-laden.

When using mine and/or recirculated plant water for sulfide flotation, selective flotation of a desired metal sulfide mineral value from other sulfides, e.g., iron sulfides, becomes difficult due to the fact that iron sulfides normally float readily in an acid medium when the familiar xanthate sulfide collectors are employed. Such acid pulps therefore limit the possibilities for selective separation of one sulfide from the other. In most cases, the desired concentrate grades can only be achieved by sacrificing the desired sulfide recovery.

One widely used remedy for such systems involves adding heavy dosages of reagents such as lime and sodium cyanide to help depress the not-to-be floated sulfides while avoiding the simultaneous depression of the to-be-floated minerals. Such reagent schedules are relatively expensive and they require great skills on the part of the operators.

Another possible remedy is to process recirculated or mine water by so-called "water treatment" in or prior to flotation. The principal methods for treating mine water and recirculated water are intended to neutralize the acidity and to remove iron. Reference is made to the SME publication. The common and most efficient water treatment makes use of lime and sodium carbonate. Even though this method is relatively frequently put to practice, it requires considerable capital expenditure for new equipment in a water treatment plant as well as additional labor to run such plant.

2. Prior Art

Cyanide salts, including complex zinc-cyanide salts, are known depressant reagents in sulfide flotation. As mentioned, high dosages of lime (to create an alkaline encironment) and sodium cyanide are frequently added to acidic water such as mine water and water from tailing ponds in order to depress iron sulfide minerals. In some flotation operations, both zinc sulfate and sodium cyanide (usually in a ratio of at least 2 parts $ZnSO_4$ to 1 part NaCN) are used to depress zinc and pyrite while floating lead at an alkaline pH.

More recently a zinc-cyanide complex reagent designated "Reagent S-622" by American Cyanamid Company has been used as a depressant. This reagent is an alkaline solution prepared by reacting about 3.3 moles zinc oxide with 1 mole sodium cyanide in water. Zinc sulfate can also be used to produce the zinc-cyanide complex but when zinc sulfate is employed it must first be neutralized with lime before reaction with sodium cyanide takes place. Zinc-cyanide complexes are used commercially as depressants to separate lead from copper and zinc sulfides and they are also used to separate silver minerals from pyrite. In both cases, the complexes are used with xanthate collectors in pulps that are at alkaline pH values.

U.S. Pat. No. 2,052,214 to Brinker deals with the separation of lead and/or copper sulfide from zinc and/or iron sulfides. The essence of the invention resides in using a zinc cyanide compound, preferably the relatively insoluble zinc cyanide ($Zn(CN)_2$), with a thiocarbanilid reagent to activate the flotation of lead and/or copper sulfides. A soluble lead salt may be added when antimony sulfides are also present in order to activate the antimony, such use of a lead salt activator being disclosed also in U.S. Pat. No. 2,007,176 to Brinker. In carrying out the process disclosed in U.S. Pat. No. 2,052,214, the flotation is carried out in a "nonbasic" pulp. Although the pulp may be acidic or slightly acidic, a neutral pulp is preferred. The U.S. Pat. No. 2,052,214 patent further teaches that the nonpreferred soluble cyanides such as zinc sodium cyanide ($Na_2Zn(CN)_4$ can be used with some ores but that the soluble cyanides will undesirably "activate zinc and/or iron sulfides." Patentee is not concerned with flotation in acidic, salt-laden pulps. Furthermore, the patent fails to teach, mention or suggest that selection of the nonpreferred soluble cyanide for use in the nonpreferred acidic pulps with a xanthate collector would result in the desirable depression of iron and zinc sulfides.

THE INVENTION

The essence of the subject invention resides in carrying out differential sulfide flotation in an acidic flotation circuit using acidic recirculated plant water or acidic mine water to form the flotation pulp and employing a water-soluble zinc cyanide complex salt as the sole depressant for iron sulfide minerals. A conventional xanthate collector is employed. The acidic recirculated or mine water that is employed is water that has not undergone treatment, such as the conventional lime treatment, to neutralize acidity and remove metal salts.

By practice of the invention, impure acidic salt-laden water may be utilized to float sulfides of bismuth, arsenic, antimony, tin and lead or complex sulfides containing one or more or these metals from iron, nickel, zinc and copper sulfide minerals which may be present.

The use of a soluble zinc-cyanide complex salt as a depressant in an acidic flotation pulp, in accordance with this invention, represents a departure from prior art uses of such complex in alkaline pulps and offers a multiplicity of practical benefits. Advantages of the process of the invention over other presently known and used methods for carrying out selective sulfide flotation wherein acidic recycled or mine water is used include:

(1) The zinc-cyanide complex salt depresses iron sulfides very efficiently in an acidic, soluble salt-loaded flotation pulp liquid phase.
(2) The complex provides excellent separation, e.g., it depresses iron sulfides, does not affect stibnite.
(3) The zinc-cyanide complex salt depressant is relatively inexpensive.
(4) The zinc-cyanide complex salt is prepared from readily available chemicals.
(5) No additional equipment (e.g., water treatment plants, etc.) is necessary.
(6) Practice of the invention does not require skillful operators.

DETAILED DESCRIPTION

The instant invention is applicable to the flotation beneficiation of ores, ore concentrates or ore preconcentrates. It may be practiced by adding the zinc-complex salt during grinding or it may be added to a pulp of ground ore prior to rougher flotation with possible further addition during cleaner flotation. Alternatively, the complex may be added to a bulk flotation concentrate before the bulk concentrate undergoes further treatment in the cleaner circuit. Open and closed flotation circuits may be employed. Other variations in processing will be obvious to those skilled in the art. Irrespective of the point of addition of the complex and whether flotation is carried out in open or closed circuit, it is essential that the selective flotation of stibnite or the like from minerals such as iron sulfides can be carried out in a pulp which is distinctly acidic. More particularly, the pulp should have a pH of about 6 or below, typically in the range of about 3.5 to 5.8. The zinc-cyanide complex reagent is alkaline, as mentioned above, and the presence of the reagent will increase the pH of the pulp prepared with mine water and/or recirculated water. This fact must be taken into consideration when determining whether to practice flotation in an open or closed circuit, as will be evident to those skilled in the art. For example, unless the water supply is highly acidic, the pH of the pulp may increase to a value close to neutrality, e.g., pH 6.8, or above when the complex is added to a bulk flotation concentrate and open circuit flotation is practiced. In such a case, the zinc-cyanide complex depressant should be added before rougher flotation; for example to the grinding circuit, and selective flotation of the to-be floated mineral is carried out in closed circuit. However, when feasible, it is preferable for economic reasons to add the zinc-cyanide complex after carrying out a bulk flotation in open circuit because less complex will be required that when the complex is incorporated before rougher flotation.

The zinc-cyanide complex used in putting the invention into practice may be prepared by premixing stoichiometric amounts of zinc oxide with sodium cyanide. Corresponding ammonium and potassium zinc-cyanide complex salt may be obtained by using ammonium or potassium cyanides as reactants. A stoichiometric amount of zinc sulfate can be used as the source of zinc ions but when the sulfate is used it will be necessary to first neutralize the sulfate salt with lime.

A suitable method for preparing the sodium complex salt from zinc oxide and zinc sulfate is described in "MINING CHEMICALS HANDBOOK, MINERAL DRESSING NOTES NO. 26," American Cyanamid Company, Wayne, New Jersey 07470.

The reaction involved in forming a zinc-cyanide complex salt is believed to be represented by the following equation:

$$20\ NaCN + 6\ ZnO + 4\ H_2O \rightarrow 5\ Na_2Zn(CN)_4 + Na_2ZnO_2 + 8\ NaOH$$

This equation is given for purposes of explanation only.

The flotation environment concerned with this invention is of an extremely complex nature and various as yet unidentified chemical reactions may be taking place. At any rate, the precise mechanism by which the method of the invention operates is not fully understood at present.

The zinc-cyanide complex reagent has been found to be an outstanding depressant in acidic salt-loaded water for iron sulfide minerals of which pyrite, marcasite and pyrrhotite are examples. Zinc, nickel and copper sulfide minerals may be depressed along with iron. The reagent does not affect the flotation of antimony sulfides (stibnite) and species such as the sulfides of bismuth, tin, arsenic and lead and complexes of the aforementioned.

The quantity of zinc-cyanide reagent used in practicing the invention will depend, of course, on the concentration of minerals which are to be depressed. Sufficient depressant must be used to minimize flotation of the not-to-be floated minerals. However, an excess is to be avoided since it may tend to depress the to-be-floated minerals and/or undesirably raise the pH of the flotation pulp to a neutral or alkaline value with the result that selective flotation is not obtained. Since the complex is produced as a reagent solution, the quantity of complex salt that is present will depend on the concentration of the reactants. In the case of a reagent prepared using water, ZnO and NaCN in weight proportions of 140:10:25, a representative reagent addition will be in the range of 50 to 2000 g./mt. (grams per metric ton), more usually in the range of 100 to 1000 g./mt. However, considerably larger or smaller amounts of the reagent may be found useful with some ores.

Representative water available from sulfide mines or tailing ponds or thickeners and used in sulfide flotation mills has a pH in the range of 2 to 6, more usually in the range of 3 to 5. In most cases, salts are predominantly sulfates. An exception would be the case of water recirculated from a plant in which hydrochloric acid or chloride salts are used as reagents. Usually a variety of metal cations including alkaline earth metal and iron cations are present. Frequently recycled or mine waters contain salts of heavy or base metals such as manganese, copper and zinc. In many cases one or more of the contaminating salts such as copper will be an activator for iron in acidic flotation circuits. In practice of the invention such water is used in untreated state or conditions, i.e., the water is used as found in an available source without having undergone any treatment other than possible clarification to remove solids.

The concentration of salts in recirculated and mine waters varies considerably. Typical values may be from 1 to 50 grams per liter. In practicing the invention it has been found that water highly loaded with metal salts may be used even when copper ions are present in appreciable concentration.

As mentioned, as advantageous feature of the invention is that conventional sulfide flotation practice may be followed. Thus, the conventional xanthate collectors are employed. Known frothers may be utilized. Activators useful with conventional sulfide collectors are employed when necessary. For example, lead nitrate or lead acetate will be used to float stibnite with a xanthate.

The following examples are given to illustrate preferred embodiments of the flotation practice of the invention.

EXAMPLE I

In this example (Test No. 1) an antimony concentrate of 63% Sb grade was produced at an 76% recovery from a run-of-mine Bolivian ore containing about 2.6% $Sb_2S_3$ (stibnite) and 4% $FeS_2$ (pyrite) using untreated acidic water which was loaded with soluble salts for flotation and a zinc-cyanide complex to depress pyrite. The run-of-mine ore was typical of the mill feed that had been concentrated in a commercial mill to produce antimony concentrates of average grade 60% Sb at an average recovery of 66%. The objective was to develop a method of treating the ore to give an improvement over present metallurgical practice and result in an increase in the recovery of the antimony contained in the ores.

For purposes of comparison the same procedure was repeated in Test No. 2 except that relatively large amounts of lime and NaCN were used, in conventional manner, to depress iron sulfides with the untreated acidic water. For further purposes of comparison, in Test No. 3 the water was pretreated in conventional manner with lime, soda ash and Calgone® TG-10 before being used in flotation and the quantities of lime and sodium cyanide added during flotation to depress pyrite were reduced.

The acid, salt-laden water that was used in all of the tests was a synthetic water carefully formulated with a mixture of sulfate salts to reproduce the composition of mill water available at the mine site. This synthetic water had the following chemical composition:

| Cation | Cation Concentration mg./l. |
|---|---|
| Zn | 1.4 |
| Fe | 991.0 |
| Cu | 0.2 |
| Mg | 279.0 |
| Ca | 113.0 |
| Al | 9.0 |
| Mn | 11.9 |
| Na | 400.0 |
| K | 100.0 |
| $SO_4$ content | 4,995.5 |

The pH of the synthetic mill water was 4.5 immediately after preparation.

Test No. 1 - Process of the Invention (Zinc-Cyanide Complex the Sole Reagent to Depress Pyrite Using Untreated Acid, Mine-Type Water A representative sample of the ore was ground at 67% solids to 39.5% minus 200 mesh (relatively coarse grind). The ore was pulped at 22% solids with the acidic, salt-loaded water and had a pH of 5.1. The pulp was conditioned for a total of 13 minutes by adding lead nitrate (300 g./mt.), AERO xanthate 350 (potassium amyl xanthate) (10 g./mt.) and Dowfroth 250 (20 g./mt.). After conditioning, pH was 5.4. The pulp was subjected to rougher flotation for 25 minutes with stage addition of AERO xanthate 350 (90 g./mt.) and Dowfroth 250 (30 g./mt.). The rougher flotation concentrate (a bulk pyrite-stibnite concentrate) was recovered and the rougher tail was discarded. The rougher concentrate was cleaned in open circuit by flotation for 10 minutes without addition of reagents. The first cleaner tail composed mainly of silicates and some locked pyrite-quartz grains was discarded.

The first cleaner concentrate composed mainly of stibnite and pyrite with a small amount of remaining silicates was conditioned for 10 minutes with 500 g./mt. of a zinc-cyanide complex. The reagent was prepared by reacting zinc oxide (100 parts by weight) and sodium cyanide (250 parts by weight) in the presence of water (1400 parts by weight) in accordance with the procedure described in "MINING CHEMICALS HANDBOOK" (supra). The addition of the complex raised the pH of the pulp to about 6.3. However, pH rapidly decreased to the 3.5 to 4.5 range during subsequent flotation stages.

The conditioned pulp was given a second cleaner flotation for 10 minutes to float stibnite from pyrite without addition of reagents. The second cleaner concentrate was cleaned for 7 minutes. This concentrate was cleaned two more times by flotation, using a flotation time of about 3 minutes for each cleaning. During all flotation stages pulp temperature was in the range of 26 to 32° C. The fourth cleaner concentrate (60% Sb grade) was recovered. All tails were discarded.

Test No. 2 - Conventional Use of CaO and NaCN To Depress Pyrite With Untreated Water A sample of the ore used in Test No. 1 was ground in a rod mill to 39.5% minus 200 mesh at 67% solids. Lime (500 g./mt.) and sodium cyanide (150 g./mt.) were added to the ore during grinding. The ground ore was pulped with the mine-type water and the procedures of Test No. 1 were repeated with the exception that the concentrate was cleaned only three times because it was observed that pyrite floated persistently through all flotation stages.

Test No. 3 - Conventional Use of Water Pretreatment With CaO, $Na_2CO_3$ and Calgon TG-10. Use of CaO and NaCN To Depress Pyrite The water used in this flotation test was produced by treating the synthetic mill water with lime in amount of 0.3 g./l. and allowing flocs to settle for 18 hours. After removing the flocs the liquid (pH 8.2) was decanted. Calgon TG-10 (0.2 g./l.) was added to soften the lime-treated water.

A sample of the ore was ground to 39.5% minus 200 mesh. Sodium cyanide (150 g./mt.) was added during grinding. The ground ore was pulped at about 22% solids in the treated mine-type water and conditioned at pH 5.5 with lead nitrate, xanthate and frother, substantially as in the other tests. After rougher flotation, the rougher concentrate was conditioned for 10 minutes with lime (30 g./mt.) and sodium cyanide (250 g./mt.). This increased pH to 6.9. The concentrate was cleaned three times without addition of reagents.

The metallurgical results for the three tests are summarized in table form. Data in the table for Test No. 1, process of the invention, show that by using a zinc-cyanide depressant a stibnite concentrate of 63.4% Sb grade was obtained at a recovery of 76.4% when floating the ore with untreated acid, mine-type water. When the prior art lime-cyanide depressant was used with the untreated water (Test No. 2), the Sb grade at all stages after the first cleaning was lower, indicating that less pyrite was depressed during cleaning. A comparison of results of Test No. 1 with those of Test No. 3 (treated water with lime-cyanide depressant) indicates that by using the zinc-cyanide complex as the sole depressant with untreated acid mine-type water the selective flotation of antimony was as good if not better than that obtained by using treated water along with the conventional depressant. (Reference is made to the projected grade and recovery for the fourth cleaner for Test No. 3 shown in the table.

EXAMPLE II

The procedures of Example I were reproduced substantially with another sample of the same run-of-mine ore ground this time to 70.5% minus 200 mesh. (In Example I the ore was more coarsely ground.) By using the zinc-cyanide complex as the sole depressant with untreated acid mine-type water the fourth cleaner concentrate had a grade of 60.1% Sb and recovery was 87.7%. From chemical assays it was found that virtually all unlocked stibnite had reported in the concentrate product. Antimony values in the tailings were in the form of oxides of antimony only. Even partially oxidized stibnite was recovered.

Comparable results could not be achieved using finer grinding and the conventional lime-sodium cyanide depressant with untreated or treated water. Thus, using large amounts of lime and sodium cyanide with untreated water concentrate grade was only 41.3% Sb after three cleanings in comparison to a grade of 55.1% Sb using the zinc-cyanide complex with three cleanings. When the water was pretreated and reduced quantities of lime and sodium cyanide were employed, the grade of the third cleaner concentrate was only 44.2%.

| RUN-OF-MINE ORE, GROUND TO 39.5% MINUS 200 MESH | | | | | | |
|---|---|---|---|---|---|---|
| Test No. | 1* | | 2* | | 3** | |
| Pyrite Depressants | Zn/CN Complex | | CaO, NaCN | | CaO, NaCN | |
| Test Products | Grade Sb, % | Recovery Sb, % | Grade Sb, % | Recovery Sb, % | Grade Sb, % | Recovery Sb, % |
| 4th cleaner conc. | 63.4 | 76.4 | — | — | 63.0*** | 76.0*** |
| 3rd cleaner conc. | 59.2 | 76.9 | 48.6 | 83.1 | 57.7 | 80.1 |
| 2nd cleaner conc. | 47.7 | 77.4 | 42.5 | 84.5 | 47.8 | 84.7 |
| 1st cleaner conc. | 26.8 | 89.6 | 33.2 | 85.8 | 35.5 | 86.5 |
| Rougher conc. | 14.9 | 91.2 | 21.7 | 87.3 | 16.7 | 89.4 |
| Head (assay) | 2.18 | — | 2.18 | — | 2.11 | — |

*Acid, mine water not treated
**Acid mine water treated with lime, sodium carbonate and Calgon TG-10 prior to grinding and flotation
***Projected values based on grade/recovery relationship curve

EXAMPLE III

The general procedures of the previous examples were repeated with old mill tailings containing about 2.3% stibnite and about 3% pyrite. The tailings had been obtained during earlier operation in which only gravity concentration was used. The tailings contained some antimony values in the form of oxides which were not recoverable by sulfide flotation.

Old Mill Tailings

Test feed was ground to 69.4% minus 200 mesh (Tyler).

In one test the ore was ground and floated in acid mine-type of water. Pyrite depression was attempted by adding lime and sodium cyanide during grinding and subsequently after rougher flotation. After three cleanings, a concentrate of 26.5% Sb grade was obtained at a 43.2% recovery.

In Another test, the acid mine-water was treated with lime prior to its use for grinding and flotation. Subsequently pyrite depression was attempted during grinding and after rougher flotation, using lime and sodium cyanide at both stages. The concentrate was of 29.2% Sb grade and recovery of Sb values was 36.0%.

In a test carried out in accordance with this invention, the acid mine-water was not treated nor was any pyrite depressant added prior to the end of the first cleaner flotation, yielding a bulk stibnite, pyrite concentrate. The first cleaner concentrate was conditioned with 500 g. of Zn/CN complex per metric ton of test feed. Reasonably improvement in the separation of stibnite from pyrite was found to result from such treatment since the third cleaner concentrate had a Sb grade of 47.0% and recovery was 46.6%. Additional fourth cleaner produced a concentrate grade of 53.6% Sb with the Sb recovery of 43.8%.

From the foregoing examples, it is seen that the invention is adapted to realize the objects set forth hereinabove together with the advantages that were enumerated.

I claim:

1. A froth flotation process for recovering stibnite from an ore, ore concentrate or ore preconcentrate containing iron sulfide minerals using acidic, recirculated or mine water containing sulfate salts of heavy metals and alkaline earth metals to form the flotation pulp, said water not having undergone conventional water treatment intended to render the water neutral and to remove metal salts, which comprises carrying out the flotation at the natural pH of the pulp, said pH being about 6 or below, in the presence of a lead salt activator and a xanthate collector for the stibnite and a previously formed alkaline water-soluble zinc-cyanide complex salt reagent as a depressant for iron sulfide minerals.

2. The process of claim 1 wherein said zinc-cyanide complex is added during grinding of an ore.

3. The process of claim 1 wherein stibnite and iron sulfide minerals are concentrated in a bulk concentrate and said zinc-cyanide complex is added to said bulk concentrate before cleaner flotation to float the stibnite.

4. The process of claim 1 wherein said zinc-cyanide complex salt reagent is produced by reacting zinc oxide or zinc sulfate with an alkaline cyanide salt in stoichiometric proportions.

5. The process of claim 1 wherein said iron sulfide minerals comprise pyrite.

* * * * *